United States Patent [19]

Darrin

[11] 4,162,583

[45] Jul. 31, 1979

[54] SHOE STIFFENER

[75] Inventor: John W. Darrin, Reading, Mass.

[73] Assignee: Bush Universal, Inc., Woburn, Mass.

[21] Appl. No.: 845,837

[22] Filed: Oct. 26, 1977

[51] Int. Cl.[2] ..... A43B 13/42; A43D 31/00

[52] U.S. Cl. ..... 36/76 R; 12/146 S; 428/480

[58] Field of Search ..... 36/76 R, 76 C; 12/146 S; 428/480, 483

[56] References Cited

U.S. PATENT DOCUMENTS

| | | | |
|---|---|---|---|
| T903,012 | 10/1972 | Quinn et al. | 428/480 |
| 1,985,545 | 12/1934 | Nickerson | 36/76 R |
| 2,232,767 | 2/1941 | Brophy | 36/76 C |
| 2,294,982 | 9/1942 | Hathaway | 36/76 R |
| 3,091,872 | 6/1963 | Baumann et al. | 36/76 R |
| 4,081,917 | 4/1978 | Bradley et al. | 36/76 R |

FOREIGN PATENT DOCUMENTS

| | | | |
|---|---|---|---|
| 1116626 | 6/1968 | United Kingdom | 36/76 R |

OTHER PUBLICATIONS

Fiber Facts, 1965–1966, FMC Corporation, American Viscose Division 1964, p. 65.

*Primary Examiner*—James Kee Chi

*Attorney, Agent, or Firm*—Wolf, Greenfield & Sacks

[57] ABSTRACT

A strip which will form a rigid shoe stiffener, such as a shoe shank, is applied to the surface of a shoe to be stiffened, such as to the bottom of the insole. The shank strip is flexible and includes a carrier sleeve containing a plurality of fiberglass strands in an externally activatable thermosetting plastic matrix. The sleeve is formed from a pair of sheets of material which are bonded to each other along their lateral, longitudinally extending margins to seal the strip as well as to provide a means by which the strip may be handled and maintained in place on the shoe bottom during activation of the strip. The margins are heat sealed in a doubled-over, folded configuration which insures that the margins will not curl over and will remain substantially flat, to facilitate handling of the strip.

5 Claims, 4 Drawing Figures

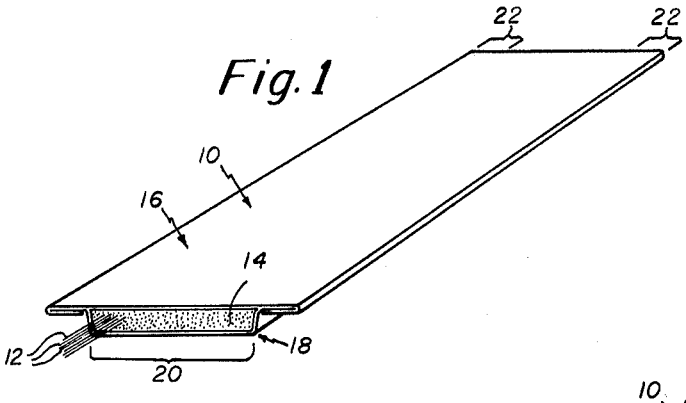
Fig. 1
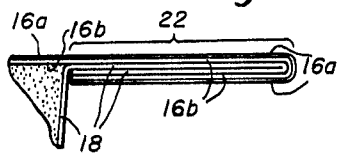
Fig. 2
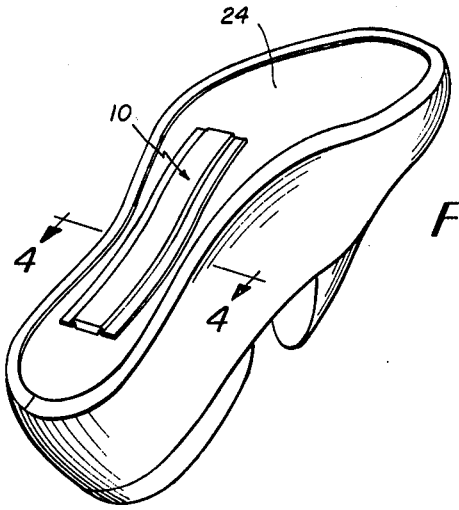
Fig. 3
Fig. 4
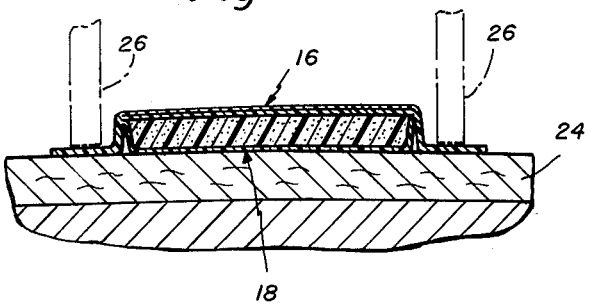

SHOE STIFFENER

BACKGROUND AND SUMMARY OF THE INVENTION

This invention relates to shoe manufacture and, particularly, to improvements in reinforcing and stiffening portions of a shoe, such as the shank region of an insole which extends from the heel to the ball portion. The invention relates to improvements and articles for forming a shank stiffener of the type disclosed in U.S. patent application Ser. No. 765,096 filed Feb. 3, 1977 and which is assigned to the assignee of this application. That application discloses techniques and articles for forming shoe shanks, the article being in the form of an elongate shank strip or rope having a carrier sleeve which contains a plurality of fiberglass strands in a thermosetting plastic resin matrix. The thermosetting matrix is activatable in response to a selected external stimulus such as, for example, radiant heat. The sleeve preferably is formed from a material which is transparent to radiant energy to permit radiant activation of the resin in situ on the insole bottom. The shank thus formed adheres to the insole bottom by way of a variety of means, including but not limited to, melting of the sleeve to form an adhesive bond, direct contact between the resin matrix and the insole, application of an adhesive layer between the shank strip and the insole or a combination of these.

The aforementioned patent application discloses an improved sleeve construction in which the sleeve is formed from a first, upper sheet and second, lower sheet or strip which may be of a different material. The upper and lower strips are attached to each other along their longitudinal edges which define the margins by which the sleeve is to be handled. The upper strip is substantially transparent to the radiant energy to permit the resin to be activated. The upper strip is formed from a material which will not deteriorate or otherwise lose its strength from exposure to the radiant heat or from exothermal heat generated during the curing process, at least until the resin has assumed a substantially final shape. The lower, insole-engaging sheet preferably is thermoplastic and will melt under the influence of the applied and/or exothermal heat to serve as an adhesive bond between the cured shank strip and the insole bottom. By way of example, the upper sheet may be formed from a polyester film such as Mylar and the lower sheet may be formed from polyethylene.

It is desirable that the margins extend laterally and in a substantially flat configuration so that they may be easily and conveniently held, gripped or otherwise manipulated. However, because of the dissimilarities in the properties of the polyester and polyethylene film, it may sometimes occur that the margins tend to curl, rather than extend laterally in a generally straight or flat configuration, as desired. When the margins curl, that makes it somewhat difficult and awkward to handle the strip by its margins. Curling of the margins may result from any of a number of causes, for example, from the heat sealing of the marginal portions of the strip, or from feeding or tensioning of the sheets during the manufacturing process. The present invention relates to an improved configuration for the margins which reduces the tendency for the margins to curl and which results in substantially flat, well-defined and projecting margins which may be easily gripped and handled.

In brief, the present invention resides in modifying the marginal portions so that they are doubled over and folded so that the top and bottom surfaces of each of the margins are defined by the first sheet, with the polyethylene portions of the margin being sandwiched and fused between the polyester material of the first, top sheet.

It is among the general objects of the invention to provide an improved shank strip of the type described.

A further object of the invention is to provide a shank strip of the type described in which the margins display little curling tendency.

Another object of the invention is to provide a shank strip of the type described in which the margins remain substantially flat and protrude substantially laterally of the shank strip to facilitate the strip being handled by its margins.

Still another object of the invention is to provide an improved elongate shank stiffener of the type described having a curable resin surrounded by a carrier sleeve and in which the sleeve has upper and lower surfaces formed from dissimilar materials, provided further with heat sealed, but uncurled margins.

DESCRIPTION OF THE DRAWINGS

The foregoing and other objects and advantages of the invention will be understood more fully from the following further description thereof, with reference to the accompanying drawings wherein:

FIG. 1 is an illustration of a portion of a rope from which a shank strip segment might be cut;

FIG. 2 is an enlarged cross sectional illustration of a portion of a shank strip including one of the margins of the strip made in accordance with the invention;

FIG. 3 is an illustration of a shoe bottom with a shank strip located on the shoe bottom; and FIG. 4 is a sectional illustration of the shank strip in place on the insole bottom as might be seen along the line 4—4 of FIG. 3.

DESCRIPTION OF THE PREFERRED EMBODIMENT

FIG. 1 shows a segment of the rope from which lengths may be severed. The rope includes an envelope in the form of an elongated outer carrier sheath or sleeve indicated generally at 10 which contains a multiplicity of elongate fiber strands 12 embedded in a fluid matrix 14 composed of a thermosetting resin and catalyst which will not polymerize or cross link under ambient conditions over long shelf lives of, for example, three months or more. The rope is flexible and long lengths of it, for example, hundreds of feet, may be wound on a reel to facilitate manufacture of the rope, storage and handling and subsequent use. The ends of the reeled-up rope preferably are sealed. Various resins and catalyst formulations and fiber reinforcements which may be used in the matrix are described in depth in U.S. patent application Ser. No. 681,562, filed Apr. 29, 1976, and assigned to the assignee of this application.

In accordance with the present invention, the carrier sleeve 10 is formed from a pair of sheets or strips of material, including what is defined as an upper or first strip 16 and a lower or second strip 18, the lower strip being intended to be applied directly to the element to be stiffened, such as an insole bottom. The upper and lower strips 16, 18 may be formed to define their carrier sleeve configuration, encasing the matrix 14 and fiberglass strands 12, by heat sealing the longitudinally extending marginal portions of the strips 16, 18. In the embodiment shown, the article is formed so that its upper strip 16 and marginal portions extend generally flat, with the lower strip 18 having a channel-shaped middle portion 20 which extends downwardly from the upper strip 16 and which contains the matrix 14 and strands 12.

The lower, insole engaging sheet or strip 18 may be formed from a relatively low melt temperature thermoplastic such as polyethylene having a melting point such that it will melt and fuse with the thermosetting resin upon cross linking and polymerization. For example, the polyethylene may melt between 175° F. to 275° F. In all cases, the lower as well as the upper strip, should be impermeable to migration outwardly of the matrix and prevent inward migration or passage of materials which might adversely affect the shelf life of the stored matrix material.

The upper strip is formed from a thin sheet of material which is transparent to the radiant energy or other external stimulus to be used to activate the matrix. As described in said application Ser. No. 765,096 the upper strip 16 preferably is formed from a material which will substantially retain its tensile properties and will not melt or otherwise adversely deteriorate during activation of the matrix, at least until the matrix has cured sufficiently to its final shape. By way of example, the upper strip 16 may be made from a number of polyester films, such as Mylar, a trademark product of polyethylene terephalate sold by E. I. duPont de Nemours & Co., Wilmington, Del. (melt temperature of about 420° F.). In addition, the upper strip of material may be a shrinkable material which, as described in application Ser. No. 765,096 helps to control the final dimensions of the shank stiffener.

The matrix 14 and fiberglass strands 12 are encased within the sleeve in its middle region suggested by the reference character 20. The middle region 20 is defined between the longitudinally extending sealed margins 22 of the shank strip.

As illustrated in FIG. 2, a severed shank strip is applied to the bottom of an insole 24 which has been located on the bottom of a shoe assembly. The strip, which is flexible and deformable, is maintained in conformity with the insole bottom, for example, by hold-down elements suggested diagrammatically at 26 (FIG. 4) which engage the strip at its margins 22. While the strip is so retained, it is exposed to an appropriate external stimulus, such as radiant heat and is caused to cure in situ on the shoe bottom.

As mentioned, there may be some instances in which single-layer laminated marginal portions 22 may tend to curl or otherwise assume a configuration which is not generally flat. This may result from a variety of factors, for example, from the heat sealing of the marginal portions of the strip, or from feeding or tensioning of the sheets during the manufacturing process or from reeling up of a long length of shank strip material on a reel. This is believed to result in part from the different properties of the materials from which the top and bottom sheets are formed. For example, with the materials described, the Mylar upper sheet will have greater tensile strength than the polyethylene sheet from which the bottom of the strip is formed. In addition, the Mylar has a significantly higher melt temperture than the polyethylene. These factors contribute to the curling tendency. For example, when simply heat sealing a single layer of polyethylene to the single layer of Mylar, the polyethylene will melt while the Mylar will not. Upon cooling, the polyethylene may tend to shrink which may result in curled margins.

In order to retard curling of the margins which would present some difficulties in the handling of the strip, such as, for example, when the strip is to be held down by its margins as suggested in FIGS. 3 and 4, the margins are formed as illustrated in enlarged FIG. 2 which is exaggerated for clarity. As may be seen from FIG. 2, the strip is formed so that the marginal portions of the sheets 16, 18 are doubled over and folded so that the resulting margins 22 define a sandwiched configuration in which the top and bottom surfaces are defined by the first sheet of material (Mylar) and in which the intermediate sandwiched layers are formed from the second sheet of material (polyethylene). The margins are heat sealed in this configuration and it has been found that the resulting margin 22 displays no appreciable curling tendency and remains substantially flat and extended, as illustrated in FIGS. 1 and 2. In addition, the folded-over margin configuration also provides an improved seal which further reduces the chance of resin leaking from the strip during storage, as well as during use.

FIG. 2 illustrates, in enlarged detail, the cross-sectional configuration of the marginal portion 22 of the strip. It should be noted that FIG. 2 is intended to illustrate the various layers of material which make up the folded-over, heat-sealed margin. When heat sealed, the inner polyethylene layers will have been fused and merged into a substantially uniform mass. It may be noted that in the embodiment illustrated in FIG. 2, the upper sheet 16 includes the polyester film **16*a* (Mylar) which has been pre-laminated with a film 16*b* of polyethylene in order to facilitate a good heat seal bond between the dissimilar polyester and polyethylene materials. Such pre-coated polyester film may be obtained commercially from a variety of sources such as, for example, Acme Backing Corp., Stamford, Conn. under the trade designation "Acmeflex" or from Union Camp Corp., Providence, R.I. Thus, as illustrated in FIG. 2, the resulting sandwich defined at the margins 22 includes top and bottom layers of the top skin material 16*a* and a mass of fused thermoplastic (polyethylene) between the polyester layers. The margins are first folded to this doubled-over configuration as shown in FIG. 2** and then heat sealed which fuses the internal polyethylene layers into a substantially unified mass.

The doubled over, folded configuration of the margins preferably is along the full width of the margins, with the reverted, terminal end of the polyester layer **16*a* extending fully inwardly to a location adjacent the middle segment 20 of the strip 10. It should be noted that where the melt temperature of the polyester top skin 16*a* is substantially higher than the melt temperature of the polyethylene layer 16*b* and the polyethylene from which the lower skin 18 is formed, the heat will not adversely affect the polyester skin but will pass through it sufficiently to melt and effect a fusion of the internal polyethylene portion of the sandwich. By sealing the margin in the folded-over configuration, the polyester layer 16*a* is disposed both on the top and the bottom of the margin 22 so that the outer surfaces of the margin 22 will have the same physical properties which may balance each other during the heat sealing process and when the rope is wound onto a reel. Moreover, it should be noted that the resulting flat margin 22** still is quite flexible and may be conformed to the shape of the insole and pressed downwardly to the bottom of the insole and held in place as suggested in FIG. 4.

An additional advantage of the present invention is that by forming the margins 22 with a surrounding skin having a higher melt temperature, sealing equipment will be protected from becoming gummed-up by the melted polyethylene of the bottom strip.

As described in application Ser. No. 765,096, alternate means may be provided to promote the heat sealing of the Mylar top skin to the polyethylene bottom skin, such as interposing a coating or thin film of ethylvinyl acetate (EVA). The use of Mylar film pre-coated with polyethylene, however, appears to be a more desirable means of promoting the heat-sealing of the margins. In either case, when the margin is doubled over and heat sealed in that configuration, the resulting margin is defined by a sandwich of external layers **16*a*** of polyester bonded together by an internal fused mass of polyethylene.

By way of example, a typical shank strip of the type shown in FIGS. 1 and 2 may have a top skin in which the Mylar film **16*a* is of the order of ¼ to ½ mil thick and which is coated with a polyethylene film 16*b* of between ½ to 1 mil thick. The lower skin 18 may be formed from 1 mil thick polyethylene. The thickness of the folded over fused sandwiched margins may be of the order of 0.003–0.006 mils thick. The margins may be 3/16 inch wide and the width of the entire shank strip may be of the order of 1⅛ inches wide. The channel-shaped middle portion 20** of the sleeve which contains the resin and fiberglass may be of the order of ¾ inch wide and approximately 0.080 inches in thickness. A typical length of shank strip will be of the order of 4 to 6 inches. The strip is used and operates in the manner described in said application Ser. No. 765,096 and reference is made thereto for a more detailed description of the manner in which the strip is applied, activated and forms the final shank.

It should be understood that the foregoing description of the invention is intended merely to be illustrative thereof and that other modifications and embodiments may be apparent to those skilled in the art without departing from its spirit.

Having thus described the invention, what I desire to claim and secure by Letters Patent is:

1. An article for use as a shoe reinforcement comprising:

an elongate sleeve surrounding a matrix which includes an externally activatable thermosetting resin, said resin being in a fluent form, said sleeve and resin being flexible and deformable as a unit to enable the article to be formed to the contour of a selected portion of the shoe assembly;

said sleeve being defined by first and second facing plastic strips sealed together at their lateral marginal edges to define margins by which the sleeve may be manipulated;

the material from which the second strip is formed being thermoplastic and meltable at a predetermined temperature;

the first strip being formed from a material which will substantially maintain its tensile strength at said predetermined temperature, the marginal portions of said first and second strip being heat sealed to each other;

said marginal portions defining a folded sandwich configuration in which the outermost layers of the margin are defined by the marginal portions of the first strip and wherein the inner portion of the sandwich is formed at least in part from the material of the second strip, the internal portion of the margin being fused in a substantially integral mass which is sealed to the outermost layer of the margins;

said margins of said sleeve being substantially free of curl and extending laterally in a generally flat configuration.

2. An article as defined in claim 1 further comprising:

said sleeve including a middle portion in which the matrix is contained, the edge of the folded marginal portion of the outermost layer extending laterally inwardly in proximity to the middle portion of the sleeve.

3. An article as defined in claim 1 further comprising:

said first strip and margins defining a generally flat, planar surface;

the second strip substantially defining a channel extending away from the upper strip, the matrix being disposed within the channel.

4. An article as defined in claim 1 wherein the first strip is formed from a polyester film and the second strip is formed from polyethylene, the polyethylene being selected to have a melt temperature substantially lower than that of the polyester.

5. An article as defined in claim 1 wherein the article is approximately 1⅛ inch wide overall and has margins which are each 3/16 inch wide, the portion of the sleeve containing the matrix being of the order of ¾ inch wide and of the order of 0.080 inch thickness, said margins being 0.002 to 0.006 mils thick.

* * * * *

UNITED STATES PATENT AND TRADEMARK OFFICE

CERTIFICATE OF CORRECTION

PATENT NO. : 4,162,583

DATED : July 31, 1979

INVENTOR(S) : John W. Darrin

It is certified that error appears in the above—identified patent and that said Letters Patent is hereby corrected as shown below:

Column 5, line 27, ".003-.006 mils thick" should read as follows:

--.003-.006 inches thick--

Signed and Sealed this

*Fourteenth* Day of *October 1980*

[SEAL]

*Attest:*

SIDNEY A. DIAMOND

*Attesting Officer*

*Commissioner of Patents and Trademarks*